US008036779B2

(12) United States Patent
Ito et al.

(10) Patent No.: US 8,036,779 B2
(45) Date of Patent: Oct. 11, 2011

(54) AIR-CONDITIONING SYSTEM CONTROLLER

(75) Inventors: Yasuyuki Ito, Yokohama (JP); Yasuo Takagi, Chigasaki (JP); Kenzo Yonezawa, Tama (JP); Yoshiki Murakami, Yokohama (JP); Nobutaka Nishimura, Koganei (JP); Nobuyuki Donen, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 192 days.

(21) Appl. No.: 12/570,929

(22) Filed: Sep. 30, 2009

(65) Prior Publication Data

US 2010/0023167 A1 Jan. 28, 2010

Related U.S. Application Data

(63) Continuation of application No. PCT/JP2008/050292, filed on Jan. 11, 2008.

(30) Foreign Application Priority Data

Apr. 4, 2007 (JP) ..... 2007-098551

(51) Int. Cl.

| | |
|---|---|
| ***G05B 13/02*** | (2006.01) |
| ***G05B 15/02*** | (2006.01) |
| ***G05B 11/01*** | (2006.01) |
| ***F28F 27/00*** | (2006.01) |
| ***F25B 49/00*** | (2006.01) |

(52) U.S. Cl. ..... 700/277; 700/9; 700/19; 700/20; 700/28; 700/33; 700/52; 700/278; 165/200; 62/132

(58) Field of Classification Search ..... 700/3, 9, 700/10, 19, 20, 28, 33, 52, 275–278, 299, 700/300; 165/200, 205; 62/132
See application file for complete search history.

(56) References Cited

U.S. PATENT DOCUMENTS

| | | | | |
|---|---|---|---|---|
| 4,406,138 | A * | 9/1983 | Nelson | 62/305 |
| 7,890,215 | B2 * | 2/2011 | Duncan | 700/276 |
| 2007/0240437 | A1 | 10/2007 | Yonezawa et al. | |
| 2008/0234869 | A1 | 9/2008 | Yonezawa et al. | |

FOREIGN PATENT DOCUMENTS

| | | |
|---|---|---|
| JP | 2004-69134 | 3/2004 |
| JP | 2004-271095 | 9/2004 |
| JP | 2004-293844 | 10/2004 |
| JP | 2005-233557 | 9/2005 |
| JP | 2005-257221 | 9/2005 |
| JP | 2006-125797 | 5/2006 |
| JP | 2006-275323 | 10/2006 |

OTHER PUBLICATIONS

International Preliminary Report on Patentability for PCT/JP2008/050292, dated Oct. 13, 2009.
International Search Report from Japanese Patent Office for International Application No. PCT/JP2008/050292, Mailed Mar. 4, 2008.

* cited by examiner

*Primary Examiner* — Sean Shechtman
(74) *Attorney, Agent, or Firm* — Finnegan, Henderson, Farabow, Garrett, Dunner, L.L.P.

(57) ABSTRACT

In an air-conditioning system controller provided with a central control unit and a local control unit, the central control unit includes a heat source machine measurement system for measuring an input/output state of a heat source machine, a setting unit for setting air-conditioning condition data on air-conditioning object spaces, an outdoor air measurement system for measuring outdoor air condition data, a total air-conditioning load operating unit, an optimal operating state estimation unit, and a heat source machine control. The total air-conditioning load operating unit calculates a total air-conditioning load or a heat exchange rate of the heat source machine based on chilled water inlet and outlet temperatures and chilled water flow rate of the heat source machine.

6 Claims, 2 Drawing Sheets

AIR-CONDITIONING SYSTEM CONTROLLER

CROSS REFERENCE TO RELATED APPLICATIONS

This is a Continuation Application of PCT Application No. PCT/JP2008/050292, filed Jan. 11, 2008, which was published under PCT Article 21(2) in Japanese.

This application is based upon and claims the benefit of priority from prior Japanese Patent Application No. 2007-098551, filed Apr. 4, 2007, the entire contents of which are incorporated herein by reference.

BACKGROUND OF THE INVENTION

1. Field of the Invention

The present invention relates to an air-conditioning system controller for controlling an air-conditioning system for cooling or heating a building such as a hospital.

2. Description of the Related Art

In recent years, there has been an increasing demand for energy saving of various types of air-conditioning equipment constituting an air-conditioning system in a building or the like. To meet this demand, a large number of air-conditioning system controllers have been proposed that can reduce the power of the air-conditioning equipment.

Many of conventional air-conditioning system controllers are based on a method in which the operating state of the air-conditioning system is changed depending on the air-conditioning load. Some following control methods are proposed.

(1) A method in which a plurality of operation modes are set in advance, optimal operation modes of the air-conditioning equipment are selected in accordance with the air-conditioning load, and the air-conditioning system is operated in the selected operation modes (e.g., Patent Document 1).

(2) A method in which the rotational rate of a compressor attached to a heat source machine is controlled in accordance with the air-conditioning load (e.g., Patent Document 2).

(3) A method in which the number of operating refrigerators is changed depending on the air-conditioning load (e.g., Patent Document 3).

(4) A method in which respective target values of coil temperatures of air-conditioning coils and chilled water temperature of a heat source machine are obtained such that the total required power of air-conditioning equipment, such as the heat source machine, water pump, and blower fans, is minimal, and thereafter, the water pump, blower fans, etc., are controlled so that the coil temperatures and chilled water temperature reach the target coil temperature values and target chilled water temperature, respectively (e.g., Patent Document 4).

Patent Document 1: Jpn. Pat. Appln. KOKAI Publication No. 2004-271095,

Patent Document 2: Jpn. Pat. Appln. KOKAI Publication No. 2006-125797.

Patent Document 3: Jpn. Pat. Appln. KOKAI Publication No. 2005-233557

Patent Document 4: Jpn. Pat. Appln. KOKAI Publication No. 2004-069134.

BRIEF SUMMARY OF THE INVENTION

The prior art control methods of Patent Documents 1 to 3 described above are intended to perform control in consideration of specific air-conditioning equipment or operating states capable of energy-saving performance, depending on the air-conditioning load, and not to optimize all the air-conditioning equipment constituting the air-conditioning system. Therefore, these prior art methods can be the to be control methods that do not pursue the maximum energy-saving effect that is thermodynamically feasible but realize partial energy saving.

On the other hand, the prior art control method of Patent Document 4 described before is an attempt to optimize all the air-conditioning equipment of the air-conditioning system. In this case, however, the air-conditioning load conditions are not taken into consideration, and a plurality of air-conditioning object spaces cannot be efficiently air-conditioned by a single heat source machine, which involve basic problems to be solved. Thus, optimal control for efficient energy-saving performance is not achieved.

Accordingly, the object of the present invention is to provide an air-conditioning system controller in which an operating state of an air-conditioning system is determined such that the total required power of air-conditioning equipment constituting the air-conditioning system is minimal, based on at least a total air-conditioning load as an input variable, and each air-conditioning equipment is controlled in accordance with the determined target value, whereby a plurality of air-conditioning object spaces are efficiently air-conditioned so that energy can be saved.

An air-conditioning system controller according to an aspect of the present invention is an air-conditioning system controller for controlling an air-conditioning system which is provided with one or more air-conditioning object spaces, a cooling tower for producing cooling water, a heat source machine including a compressor which receives the cooling water produced by the cooling tower and performs a refrigeration cycle operation for producing chilled water of a predetermined temperature, chilled water coils which are located individually for the air-conditioning object spaces and produces air for cooling the air-conditioning object spaces through heat exchange between the chilled water produced by the heat source machine and at least air in the air-conditioning object spaces, a cooling water pump which supplies and circulates the cooling water produced by the cooling tower in the heat source machine, a chilled water pump which supplies and circulates the chilled water produced by the heat source machine in the chilled water coils, blower fans which deliver the air produced by the chilled water coils into the corresponding air-conditioning object spaces, and a cooling tower fan which supplies and circulates the air for the heat exchange in the cooling tower, and comprises a central control unit for controlling air-conditioning equipment associated with an operation of the heat source machine of the air-conditioning system and a local control unit for controlling air-conditioning of the air-conditioning object spaces, the central control unit including a heat source machine measurement system for measuring input/output state data of the heat source machine, an air-conditioning condition setting unit for setting air-conditioning condition data on the air-conditioning object spaces, an outdoor air measurement system for measuring outdoor air condition data, total air-conditioning load operating means for calculating a total air-conditioning load equivalent to a quantity of heat exchanged in a unit time between a refrigerant in the heat source machine and the chilled water introduced from the chilled water coils, based on a chilled water inlet temperature and a chilled water outlet temperature of the heat source machine and a chilled water flow rate of the heat source machine, optimal operating state estimation means for estimating a state quantity for optimally controlling the air-conditioning equipment of the air-conditioning system, based on the total air-conditioning load calculated by the total air-conditioning load operating means, the air-conditioning condition data set in the air-conditioning condition setting unit, and the outdoor air condition data measured by the outdoor air measurement system, as input variables, and heat source machine control means for controlling respective rotational rates of the cooling tower fan, the cooling water pump, the chilled water pump, and the compressor so that the state data measured by the heat source machine measurement system is coincident with the state quantity estimated by the optimal operating state estimation means.

The optimal operating state estimation means estimates state quantities (target values), including a temperature and flow rate of the cooling water introduced into the heat source machine and a temperature and flow rate of the chilled water delivered from the heat source machine, such that total required power of the cooling tower fan, the cooling water pump, the chilled water pump, and the compressor, as the air-conditioning equipment of the air-conditioning system, is minimal, based on the total air-conditioning load calculated by the total air-conditioning load operating means, the air-conditioning object space air-conditioning condition data, and the outdoor air condition data, as the input variables.

Further, the local control unit is configured to control a regulating valve which determines an opening of a valve for settling rotational rates or air delivery rates of the blower fans for delivering cooling air individually into the air-conditioning object spaces so that air-conditioning object space air temperatures, air-conditioning object space supply air temperatures or air-conditioning object space humidities or wet-bulb temperatures measured by object space measurement systems for the individual air-conditioning object spaces are equal to air-conditioning object space air temperatures, air-conditioning object space supply air temperatures or air-conditioning object space humidities or wet-bulb temperatures set in the air-conditioning condition setting unit.

An air-conditioning system controller according to a second aspect of the present invention is provided with the aforementioned central control unit and the aforementioned local control unit, the central control unit being configured to control the air-conditioning equipment of the air-conditioning system after obtaining a temporary value of the total air-conditioning load, and the local control unit being configured to perform control such that physical quantities measured by the object space measurement systems for the individual air-conditioning object spaces are approximated to physical quantities set in the air-conditioning condition setting unit thereafter, the central control unit being configured to obtain a more real value of the total air-conditioning load after the control of the local control unit so that the central control unit and the local control unit cooperate and collaborate with each other to control the air-conditioning equipment of the air-conditioning system.

DETAILED DESCRIPTION OF THE INVENTION

An embodiment of the present invention will now be described with reference to the drawings.

Before describing the present embodiment, it is generally necessary first, in order to achieve an ideal energy-saving operation of an air-conditioning system, to estimate state quantities, such as optimum temperatures and flow rates of working fluids, e.g., chilled water and air that convey heat, such that the total required power of all air-conditioning equipment constituting the air-conditioning system is minimal, based on the enthalpy balance between the working fluids, mass balance of water vapor in the air, etc., as constraint conditions, and to control the operation of the air-conditioning equipment constituting the air-conditioning system so that actual measured values are coincident with the estimated state quantities.

Thereupon, premises are designed such that the total air-conditioning load of the air-conditioning system is temporarily estimated by calculating the quantity of heat exchanged between chilled water used to air-condition at least a plurality of spaces (rooms) assumed to be air-conditioned and a heat source machine for producing the chilled water, and that the estimated total air-conditioning load becomes equivalent to a real total air-conditioning load when desired air conditions (temperature, humidity, etc.) are attained by the air-conditioning system. If the desired air conditions (temperature, humidity, etc.) are attained by the air-conditioning system, an optimal operating state of the heat source machine is estimated such that the total required power of all the air-conditioning equipment of the air-conditioning system is minimal, based on the real total air-conditioning load of the air-conditioning system obtained from the quantity of heat exchanged between at least the heat source machine and chilled water coils, as an input variable. It is believed that a plurality of air-conditioning object spaces can be efficiently air-conditioned to achieve the ideal energy-saving operation of the air-conditioning system by controlling all the air-conditioning equipment of the air-conditioning system based on the estimated state quantities.

An air-conditioning system controller according to the present embodiment has been realized in consideration of these circumstances.

(Configuration of Air-Conditioning System)

Figure 1:
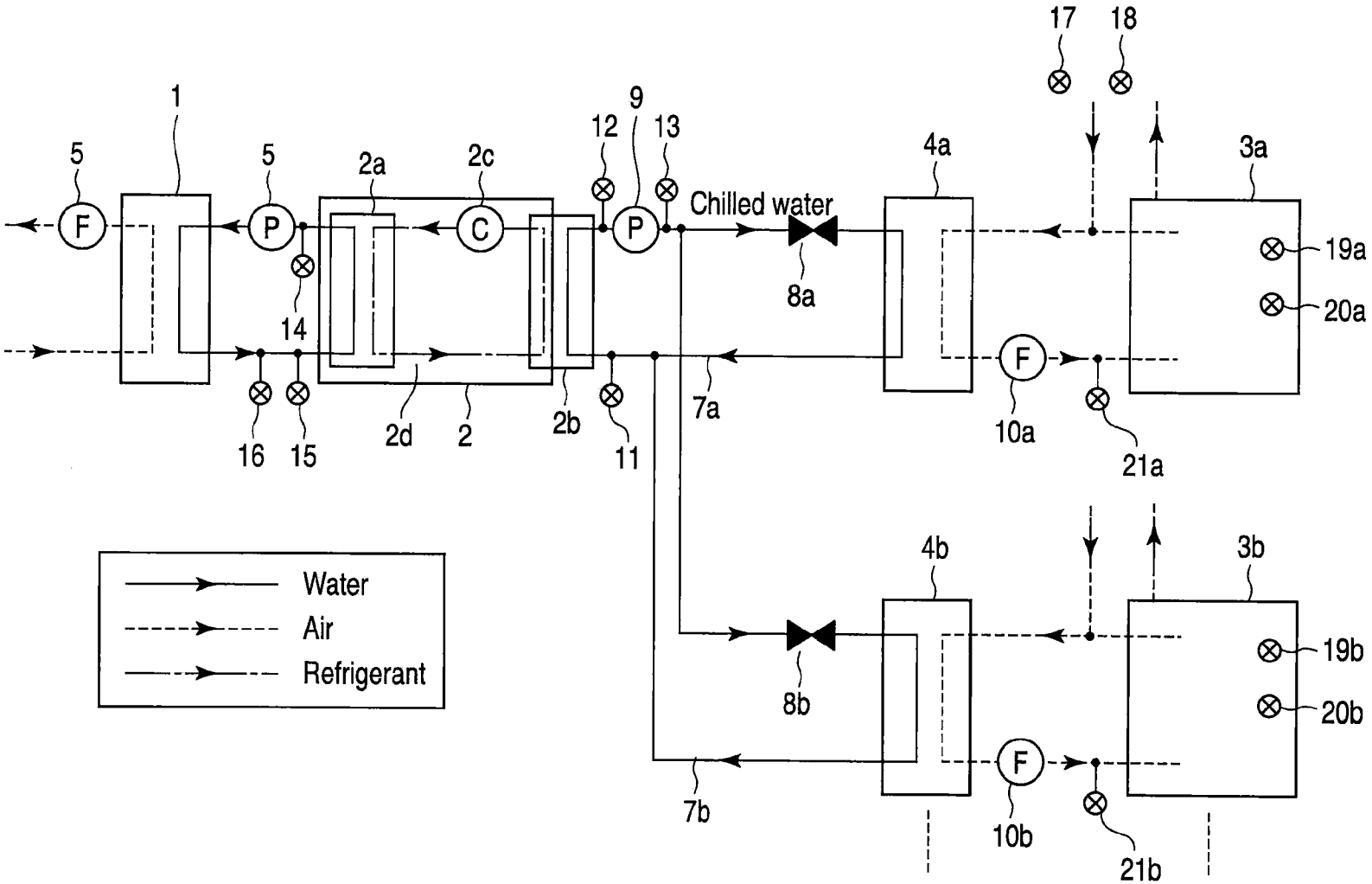
FIG. 1 is a typical configuration diagram of an air-conditioning system according to an embodiment of the present invention.

FIG. 1 is a diagram showing a typical configuration of the air-conditioning system to be controlled.

The typical conventional air-conditioning system is composed of a cooling tower 1, heat source machine (refrigerator) 2, and chilled water coils 4*a*, 4*b* installed for a plurality of air-conditioning object spaces (rooms) 3*a*, 3*b* respectively. The air-conditioning system is configured to air-condition the plurality of air-conditioning object spaces 3*a*, 3*b*. In this case, however, only the two air-conditioning object spaces 3*a* and 3*b*, for example, are illustrated and described for simplicity. The air-conditioning object spaces are ordinary spaces to be air-conditioned, such as living rooms, which are partitioned by structures.

The cooling tower 1 is a device for radiating heat produced by the heat source machine 2 into the atmosphere. In general, it is controlled so as to drive a cooling tower fan 5 and produce cooling water of a certain temperature through exchange of heat as cooling load heat between air and water. The cooling water from the cooling tower 1 is supplied to the heat source machine 2 by a cooling water pump 6. The cooling water pump 6 is controlled by the air-conditioning system controller of the present embodiment shown in FIG. 2 with the aid of an inverter (not shown).

The heat source machine 2 has a function to produce chilled water for cooling at a predetermined temperature by exchanging heat with the cooling water supplied from the cooling tower 1, includes a circulation path formed of a condenser 2*a*, evaporator 2*b*, and compressor 2*c*, and performs a refrigeration cycle operation.

Thus, within the heat source machine 2, the condenser 2*a* performs heat exchange between a refrigerant 2*d* and the cooling water supplied from the cooling tower 1 as the cooling water pump 6 is driven. Thereafter, the refrigerant 2*d* is fed to the evaporator 2*b*, in which it exchanges heat with the chilled water introduced through the chilled water coils 4*a* and 4*b*, thereby producing the chilled water of the predetermined temperature.

The chilled water inlet and outlet sides of the evaporator 2*b* of the heat source machine diverge into a plurality of branch lines 7*a* and 7*b*, to which the chilled water coils 4*a* and 4*b* are connected through flow control valves 8*a* and 8*b*, respectively.

The water cooled by the heat source machine 2 as a chilled water pump 9 is driven is supplied to the chilled water coils 4*a* and 4*b* through the branch lines 7*a* and 7*b*, respectively. After cooling an air mixture (mixture of some of air from the spaces and the outdoor air) supplied from the air-conditioning object spaces 3*a* and 3*b* through heat exchange between the air mixture and the chilled water fed through the branch lines 7*a* and 7*b*, the chilled water coils 4*a* and 4*b* return the chilled air to the air-conditioning object spaces 3*a* and 3*b* by means of blower fans 10*a* and 10*b*, respectively, thereby cooling the air-conditioning object spaces 3*a* and 3*b*.

As for the air-conditioning object spaces 3*a* and 3*b*, they can also be heated by heating the air mixture to produce warm air of a predetermined temperature in accordance with the same processing routine as aforementioned and then returning the warm air to the air-conditioning object spaces 3*a* and 3*b*.

(Configuration of Air-Conditioning System Controller)

Figure 2:
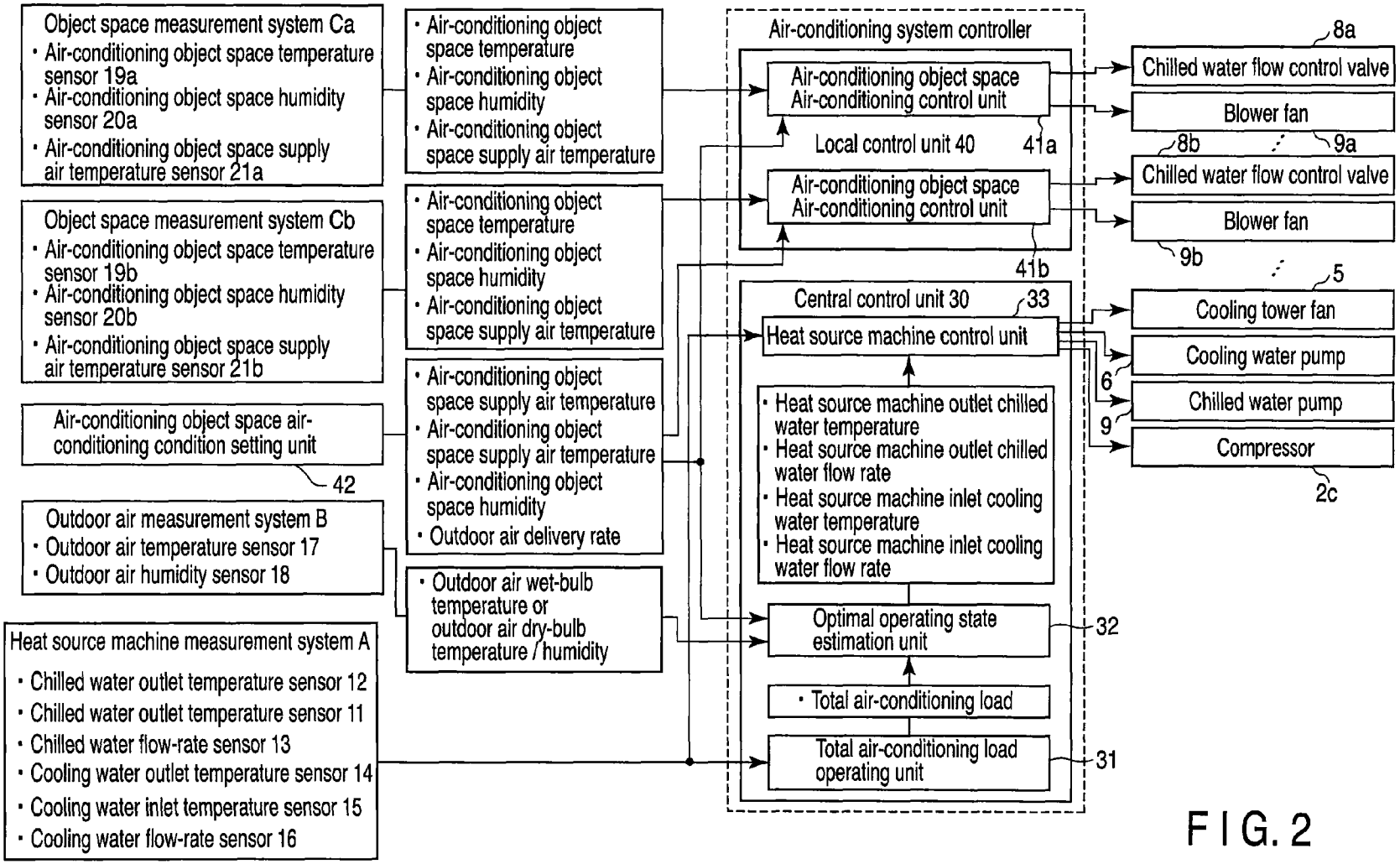
FIG. 2 is a configuration diagram of an air-conditioning system controller according to the present embodiment.

FIG. 2 is a diagram showing a configuration of the air-conditioning system controller for controlling the operations of the air-conditioning equipment of the air-conditioning system related to the present embodiment.

In controlling the operation of the air-conditioning system, the air-conditioning system controller needs to measure physical quantities at required spots of the air-conditioning system. Specifically, a chilled water inlet temperature sensor 11, chilled water outlet temperature sensor 12, and chilled water flow-rate sensor 13 are located in chilled water inlet and outlet lines of the heat source machine 2, while a cooling water outlet temperature sensor 14, cooling water inlet temperature sensor 15, and cooling water flow-rate sensor 16 are located in cooling water outlet and inlet lines of the heat source machine 2. These sensors 11 to 16 constitute a heat source machine measurement system A.

Further, an outdoor air temperature sensor 17 and outdoor air humidity sensor 18 are located near the peripheries of the air-conditioning object spaces 3*a* and 3*b* constituting the air-conditioning system and constitute an outdoor air measurement system B.

In the air-conditioning object spaces 3*a* and 3*b*, moreover, object space temperature sensors 19*a* and 19*b* and object space humidity sensors 20*a* and 20*b* are located individually for the air-conditioning object spaces 3*a* and 3*b*. Furthermore, object space supply air temperature sensors 21*a* and 21*b* are located in chilled air supply lines of the chilled water coils 4*a* and 4*b* and constitute object space measurement systems Ca and Cb, respectively.

A main body part of the air-conditioning system controller is roughly composed of a central control unit 30 and local control unit 40 and is further provided with an air-conditioning object space air-conditioning condition setting unit 42. Previously set in the air-conditioning object space air-conditioning condition setting unit 42 are an air-conditioning object space supply air temperature or air-conditioning object space humidity and an outdoor air delivery rate.

The central control unit 30 comprises a total air-conditioning load operating unit 31, optimal operating state estimation unit 32, and heat source machine control unit 33. The total air-conditioning load operating unit 31 calculates a total air-conditioning load of the air-conditioning system based on the heat exchange rate of the heat source machine 2. The optimal operating state estimation unit 32 estimates an optimal operating state of the air-conditioning system such that the total required power of the air-conditioning equipment constituting the air-conditioning system is minimal, based on the total air-conditioning load calculated by the total air-conditioning load operating unit 31, air-conditioning condition data set in the air-conditioning object space air-conditioning condition setting unit 42, and outdoor air condition data measured by the outdoor air measurement system B, as input variables. The heat source machine control unit 33 controls the air-conditioning equipment of the air-conditioning system, e.g., the cooling tower fan 5, cooling water pump 6, chilled water pump 9, and compressor 2*c*, based on an optimal operating state quantity estimated by the estimation unit 32 and a state quantity related to the cooling water.

The local control unit 40 is provided with air-conditioning object space air-conditioning control units 41*a* and 41*b* corresponding to the air-conditioning object spaces 3*a* and 3*b*, respectively. The air-conditioning object space air-conditioning control units 41*a* and 41*b* serve to control the openings of the flow control valves 8*a* and 8*b* for settling the flow rate or flow-rate distribution of the chilled water introduced into the chilled water coils 4*a* and 4*b* and the rotational rates or air delivery rates of the blower fans 10*a* and 10*b* for delivering cooling air individually into the air-conditioning object spaces 3*a* and 3*b*, the chilled water flow control valves 8*a* and 8*b* and blower fans 10*a* and 10*b* being associated with the air-conditioning of the air-conditioning object spaces 3*a* and 3*b*.

Of air-conditioning object space air-conditioning control units 41*a*, 41*b* only the two air-conditioning object space air-conditioning control units 41*a* and 41*b* are illustrated corresponding to the two air-conditioning object spaces 3*a* and 3*b* for simplicity. However, they may be increased in number as required, corresponding to the number of air-conditioning object spaces.

(Operation of Air-Conditioning System Controller)

The following is a description of the operation of the air-conditioning system controller according to the present embodiment.

The total air-conditioning load operating unit 31 that constitutes the central control unit 30 captures a chilled water inlet temperature from the chilled water inlet temperature sensor 11 as the heat source machine measurement system A, chilled water outlet temperature from the chilled water outlet temperature sensor 12, and chilled water flow rate from the chilled water flow-rate sensor 13 on the chilled water outlet side of the evaporator, and calculates an input/output enthalpy difference of the chilled water evaporator 2*b* based on the chilled water inlet temperature and chilled water outlet temperature of the evaporator 2*b*.

The total air-conditioning load operating unit 31 calculates the quantity of heat exchanged between the refrigerant 2*d* and chilled water in the evaporator 2*b* in the heat source machine 2, based on an operational expression "(enthalpy difference between outlet and inlet of evaporator)×(chilled water flow rate)", using the calculated enthalpy difference between the outlet and inlet of the evaporator and chilled water flow rate, estimates the calculated quantity of exchanged heat as the total air-conditioning load, and delivers it to the optimal operating state estimation unit 32.

Since the air conditions (e.g., temperature, humidity, etc.) of the air-conditioning object spaces 3*a* and 3*b* are not the desired ones, however, the estimated value of total air-conditioning load in this stage is a temporary total air-conditioning load of the air-conditioning system. This is because while the air-conditioning object space air-conditioning control units 41*a* and 41*b* control the pieces of air-conditioning equipment 8*a*, 8*b*, 10*a* and 10*b* associated with the air-conditioning of the air-conditioning object spaces 3*a* and 3*b*, the desired air conditions of the air-conditioning object spaces 3*a* and 3*b* are not reached yet.

When the air-conditioning object space air-conditioning control units 41*a* and 41*b* control the pieces of air-conditioning equipment 8*a*, 8*b*, 10*a* and 10*b* and as the air conditions of the air-conditioning object spaces 3*a* and 3*b* approach the desired ones, a real exchanged heat quantity and hence the real total air-conditioning load are approached. Consequently, the central control unit 30 and local control unit 40 cooperate and collaborate with each other to repeat the control, so that the central control unit 30 can determine the optimal operating state based on the real total air-conditioning load.

On receipt of the total air-conditioning load from the total air-conditioning load operating unit 31, the optimal operating state estimation unit 32 captures air-conditioning condition data set in the air-conditioning object space air-conditioning condition setting unit 42, that is, an air-conditioning object space temperature, the air-conditioning object space supply air temperature or air-conditioning object space humidity, and the set outdoor air delivery rate, and outdoor air condition data measured by the outdoor air measurement system B, that is, an outdoor air wet-bulb temperature measured by the outdoor air temperature sensor (wet-bulb temperature sensor or the like) 17, calculates the temperature and flow rate of chilled water delivered from the heat source machine for optimal control of the pieces of air-conditioning equipment 5, 6, 9 and 2*c* of the air-conditioning system and the temperature and flow rate of chilled water introduced into the heat source machine, and delivers the calculated values to the heat source machine control unit 33.

The optimal operating state implies the physical quantities of the working fluids in the air-conditioning system such that the total value of the required power of the cooling tower fan 5, cooling water pump 6, chilled water pump 9, compressor 2*c*, blower fans 10*a* and 10*b*, etc., shown in FIG. 1 is minimal, compared with the air-conditioning object space air temperature, air-conditioning object space supply air temperature or air-conditioning object space humidity, and set outdoor air delivery rate of the air-conditioning object space air-conditioning condition setting unit 42 and the outdoor air temperature and outdoor air humidity or outdoor air wet-bulb temperature measured by the outdoor air temperature sensor 17 and outdoor air humidity sensor 18 of the outdoor air measurement system B. These physical quantities are the respective values of the temperature and flow rate of the chilled water introduced into the heat source machine and the temperature and flow rate of the chilled water delivered from the heat source machine. Optimal values of the physical quantities may be calculated based on both the outdoor air dry-bulb temperature and outdoor air humidity in place of the aforementioned outdoor air wet-bulb temperature.

Thus, the optimal operating state estimation unit 32 may be based on a method in which the optimal values of the physical quantities of the working fluids obtained so that the aforementioned total value of the required power of the cooling tower fan 5, cooling water pump 6, chilled water pump 9, compressor 2*c*, and blower fans 10*a* and 10*b* is minimal are previously obtained, by mathematical programming, as a function of input variables, which include the total air-conditioning load, air-conditioning condition data of the air-conditioning object space air-conditioning condition setting unit 42, and various outdoor air condition data of the outdoor air measurement system B, and are estimated according to a previously incorporated calculation program.

After obtaining the temperature and flow rate of the chilled water introduced into the heat source machine and the temperature and flow rate of the chilled water delivered from the heat source machine, as the physical quantities of the working fluids, the optimal operating state estimation unit 32 delivers the obtained values to the heat source machine control unit 33.

On receipt of the optimal values of the physical quantities of the working fluids, the heat source machine control unit 33 controls the inverter (not shown) or the like that determines the operations, e.g., rotational rates, of the cooling tower fan 5, cooling water pump 6, chilled water pump 9, compressor 2*c*, and blower fans 10*a* and 10*b* so that a cooling water inlet temperature measured by the cooling water inlet temperature sensor 15 of the heat source machine measurement system A, cooling water flow rate measured by the cooling water flow-rate sensor 16, chilled water outlet temperature measured by the chilled water outlet temperature sensor 12, and chilled water flow rate measured by the chilled water flow-rate sensor 13 are equal to the optimal values of the physical quantities of the working fluids.

In this heat source machine control unit 33, at least the operation of the cooling tower fan 5 is controlled so that the cooling water inlet temperature of the cooling water inlet temperature sensor 15 is equal to the optimized temperature of the cooling water introduced into the heat source machine, the operation of the cooling water pump 6 is controlled so that the cooling water flow rate from the cooling water flow-rate sensor 16 is equal to the optimized flow rate of the cooling water introduced into the heat source machine, the operation of the chilled water pump 9 is controlled so that the chilled water flow rate from the chilled water flow-rate sensor 13 is equal to the optimized flow rate of the chilled water delivered from the heat source machine, and the operation of the compressor 2*c* controlled so that the chilled water outlet temperature from the chilled water outlet temperature sensor 12 is equal to the optimized temperature of the chilled water delivered from the heat source machine. In doing this, the cooling water outlet temperature sensor 14 may be used in place of the cooling water inlet temperature sensor 15.

On the other hand, the local control unit 40 controls air conditions (e.g., temperature, humidity, etc.) of the air-conditioning object spaces 3*a* and 3*b* corresponding to the air-conditioning object space air-conditioning control units 41*a* and 41*n*.

Thus, if the optimal state of the heat source machine is determined, the air-conditioning object space air-conditioning control units 41*a* and 41*n* control the flow control valves 8*a* and 8*b* and blower fans 10*a* and 10*b* corresponding to the air-conditioning object spaces 3*a* and 3*b*, respectively, so that temperatures measured by the air-conditioning object space temperature sensors 19*a* and 19*b* of the object space measurement systems Ca and Cb located in the air-conditioning object spaces 3*a* and 3*b*, respectively, and supply air temperatures measured by the air-conditioning object space supply air temperature sensors 21*a* and 21*b* are equal to air temperatures and supply air temperatures set in the air-conditioning object space air-conditioning condition setting unit 42.

The air-conditioning object space humidity sensors 20*a* and 20*b* may be used in place of the air-conditioning object space supply air temperature sensors 21*a* and 21*n*, respectively. For the rate of air delivery into the air-conditioning object spaces 3*a* and 3*b*, moreover, the openings of valves and dampers may be controlled together with the rotational rates of the blower fans 10*a* and 10*b* that are disposed individually in the air-conditioning object spaces 3*a* and 3*b*, if the valves and dampers are controlled in place of the blower fans 10*a* and 10*b*.

In this embodiment, furthermore, the air-conditioning object space air-conditioning control units 41*a* and 41*n* are provided for the individual air-conditioning object spaces 3*a* and 3*b*. Alternatively, however, some air-conditioning object spaces 3*a*, 3*b* may be sequentially controlled in order at predetermined time intervals by, for example, a single air-conditioning object space air-conditioning control unit.

In the air-conditioning control of the air-conditioning system, constraint conditions based on the enthalpy balance of the air-conditioning object space 3*a*, chilled water-air enthalpy balance of the chilled water coil 4*a*, and heat exchange properties are equal in number to controlled variables, so that the controlled variables need not be optimized. As the air conditions of the air-conditioning object space 3*a* are approximated to the set air-conditioning condition data, however, the total air-conditioning load calculated by the total air-conditioning load operating unit 31 changes. As this is done, the optimal operating state estimated by the optimal operating state estimation unit 32 also changes.

Thus, in the air-conditioning system controller, the real total air-conditioning load can be calculated by the total air-conditioning load operating unit 31 of the central control unit 30 when the air conditions of the air-conditioning object space 3*a* are substantially coincident with the set air-conditioning condition data as the central control unit 30 and local control unit 40 cooperate and collaborate with each other, and in addition, an optimal operating state such that the total value of the required power of the air-conditioning equipment of the air-conditioning system is minimal can be estimated from the real total air-conditioning load by the optimal operating state estimation unit 32.

According to the embodiment described above, therefore, the temporary total air-conditioning load is calculated from the actual quantity of heat exchange between the heat source machine 2 and chilled water coils 4*a*, 4*b* in an initial stage, and the pieces of air-conditioning equipment of the air-conditioning system are controlled based on the optimal operating state quantity of the air-conditioning system with the total air-conditioning load used as a variable. The real total air-conditioning load is calculated by the total air-conditioning load operating unit 31 of the central control unit 30 when the air conditions of the air-conditioning object space 3*a* are made substantially coincident with the set air-conditioning condition data by the local control unit 40. If the optimal operating state quantity of the air-conditioning system is determined under the real total air-conditioning load by the optimal operating state estimation unit 32 after this is done, a plurality of air-conditioning object spaces 3*a*, 3*b* can be efficiently air-conditioned, and hence, the air-conditioning system can be made energy-saving.

Further, the present invention is not limited to the embodiment described above and can be variously modified without departing from its spirit.

The present invention is applicable to an air-conditioning system controller in which an operating state of an air-conditioning system is determined such that the total required power of air-conditioning equipment constituting the air-conditioning system is minimal, based on at least a total air-conditioning load as an input variable, and each piece of air-conditioning equipment is controlled in accordance with the determined target value, whereby a plurality of air-conditioning object spaces can be efficiently air-conditioned, and hence, energy can be saved.

What is claimed is:

1. In an air-conditioning system controller for controlling an air-conditioning system provided with one or more air-conditioning object spaces, a cooling tower for producing cooling water, a heat source machine including a compressor which receives the cooling water produced by the cooling tower and performs a refrigeration cycle operation for producing chilled water of a predetermined temperature, chilled water coils which are located individually for the air-conditioning object spaces and produces air for cooling the air-conditioning object spaces through heat exchange between the chilled water produced by the heat source machine and at least air in the air-conditioning object spaces, a cooling water pump which supplies and circulates the cooling water produced by the cooling tower in the heat source machine, a chilled water pump which supplies and circulates the chilled water produced by the heat source machine in the chilled water coils, blower fans which deliver the air produced by the chilled water coils into the corresponding air-conditioning object spaces, and a cooling tower fan which supplies and circulates the air for the heat exchange in the cooling tower, the air-conditioning system controller comprising:

a central control unit for controlling air-conditioning equipment associated with an operation of the heat source machine of the air-conditioning system; and a local control unit for controlling air-conditioning of the air-conditioning object spaces, wherein the central control unit includes:

a heat source machine measurement system for measuring input/output state data of the heat source machine;

an air-conditioning condition setting unit for setting air-conditioning condition data on the air-conditioning object spaces;

an outdoor air measurement system for measuring outdoor air condition data;

total air-conditioning load operating means for calculating a total air-conditioning load equivalent to a quantity of heat exchanged in a unit time between a refrigerant in the heat source machine and the chilled water introduced from the chilled water coils, based on a chilled water inlet temperature and a chilled water outlet temperature of the heat source machine and a chilled water flow rate of the heat source machine;

optimal operating state estimation means for estimating a state quantity for optimally controlling the air-conditioning equipment of the air-conditioning system, based on the total air-conditioning load calculated by the total air-conditioning load operating means, the air-conditioning condition data set in the air-conditioning condition setting unit, and the outdoor air condition data measured by the outdoor air measurement system, as input variables; and heat source machine control means for controlling respective rotational rates of the cooling tower fan, the cooling water pump, the chilled water pump, and the compressor so that the state data measured by the heat source machine measurement system is coincident with the state quantity estimated by the optimal operating state estimation means.

2. The air-conditioning system controller according to claim 1, wherein the air-conditioning condition data set in the air-conditioning condition setting unit includes an air-conditioning object space air temperature, air-conditioning object space supply air temperature or air-conditioning object space humidity or wet-bulb temperature, and rate of outdoor air delivery into all the air-conditioning object spaces, and the outdoor air condition data measured by the outdoor air measurement system includes an outdoor air dry-bulb temperature and outdoor air humidity or an outdoor air wet-bulb temperature.

3. The air-conditioning system controller according to claim 1 or 2, wherein the optimal operating state estimation means estimates state quantities, including a temperature and flow rate of the cooling water introduced into the heat source machine and a temperature and flow rate of the chilled water delivered from the heat source machine, such that total required power of all the blower fans for driving air for cooling the air-conditioning object spaces, the cooling water pump, the chilled water pump, and the compressor is minimal, based on the total air-conditioning load calculated by the total air-conditioning load operating means, the air-conditioning object space air-conditioning condition data, and the outdoor air condition data, as the input variables.

4. The air-conditioning system controller according to claim 1, which further comprises air-conditioning condition setting means for setting a rate of air delivery into all the air-conditioning object spaces, temperature of the air-conditioning object spaces, humidity or wet-bulb temperature of the air-conditioning object spaces, or temperature of air supplied to air-condition the air-conditioning object spaces, wherein the optimal operating state estimation means is configured to estimate the state quantity based on a function of variables including a set value set by the air-conditioning condition setting means, the total air-conditioning load, and an outdoor air wet-bulb temperature as outdoor air condition data.

5. The air-conditioning system controller according to claim 1, wherein the local control unit is configured to control a regulating valve which determines an opening of a valve for settling rotational rates or air delivery rates of the blower fans for delivering cooling air individually into the air-conditioning object spaces so that air-conditioning object space air temperatures, air-conditioning object space supply air temperatures or air-conditioning object space humidities or wet-bulb temperatures measured by object space measurement systems for the individual air-conditioning object spaces are equal to air-conditioning object space air temperatures, air-conditioning object space supply air temperatures or air-conditioning object space humidities or wet-bulb temperatures set in the air-conditioning condition setting unit.

6. An air-conditioning system controller according to claim 5, the central control unit being configured to control the air-conditioning equipment of the air-conditioning system after obtaining a temporary value of the total air-conditioning load, and the local control unit being configured to perform control such that physical quantities measured by the object space measurement systems for the individual air-conditioning object spaces are approximated to physical quantities set in the air-conditioning condition setting unit thereafter, the central control unit being configured to obtain a more real value of the total air-conditioning load after the control of the local control unit so that the central control unit and the local control unit cooperate and collaborate with each other to control the air-conditioning equipment of the air-conditioning system.

* * * * *

UNITED STATES PATENT AND TRADEMARK OFFICE

CERTIFICATE OF CORRECTION

PATENT NO. : 8,036,779 B2
APPLICATION NO. : 12/570929
DATED : October 11, 2011
INVENTOR(S) : Ito et al.

It is certified that error appears in the above-identified patent and that said Letters Patent is hereby corrected as shown below:

Claim 5, column 12, line 7, change “settling rotational” to --setting rotational--.

Signed and Sealed this
Sixth Day of March, 2012

David J. Kappos

David J. Kappos
*Director of the United States Patent and Trademark Office*